US008622526B2

(12) United States Patent
Munakata

(10) Patent No.: US 8,622,526 B2
(45) Date of Patent: Jan. 7, 2014

(54) LIQUID EJECTING HEAD AND LIQUID EJECTING APPARATUS

(75) Inventor: Manabu Munakata, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 38 days.

(21) Appl. No.: 13/431,812

(22) Filed: Mar. 27, 2012

(65) Prior Publication Data

US 2012/0249682 A1 Oct. 4, 2012

(30) Foreign Application Priority Data

Mar. 29, 2011 (JP) ..... 2011-071872

(51) Int. Cl.
*B41J 2/045* (2006.01)

(52) U.S. Cl.
USPC ..... 347/68

(58) Field of Classification Search
USPC ..... 347/67, 68, 69, 70–72
See application file for complete search history.

(56) References Cited

U.S. PATENT DOCUMENTS

| | | | | |
|---|---|---|---|---|
| 6,494,566 | B1 | 12/2002 | Kishino et al. | |
| 7,919,904 | B2 * | 4/2011 | Sugahara et al. | 310/331 |
| 8,047,635 | B2 * | 11/2011 | Okubo | 347/68 |
| 8,454,133 | B2 * | 6/2013 | Mizukami et al. | 347/70 |

FOREIGN PATENT DOCUMENTS

| | | |
|---|---|---|
| JP | 10-286956 A | 10/1998 |
| JP | 10-305574 A | 11/1998 |

* cited by examiner

*Primary Examiner* — Lamson Nguyen
(74) *Attorney, Agent, or Firm* — Kilpatrick Townsend & Stockton LLP

(57) ABSTRACT

A nozzle plate made of conductive ceramics is grounded. Therefore, electric charges do not easily accumulate on the nozzle plate. The migration of electric charges from nozzle orifices to a diaphragm plate through ink filled in pressure generation chambers is unlikely to occur or significantly less likely to occur. Thus, it is possible to prevent the dielectric breakdown of the diaphragm plate caused conventionally by accumulated electric charges and to provide an ink-jet recording head that is substantially free from the damage of a driving circuit.

6 Claims, 4 Drawing Sheets

LIQUID EJECTING HEAD AND LIQUID EJECTING APPARATUS

BACKGROUND

1. Technical Field

The present invention relates to a liquid ejecting head and a liquid ejecting apparatus using the liquid ejecting head.

2. Related Art

A liquid ejecting head that ejects liquid through nozzle orifices is used in various kinds of liquid ejecting apparatuses. Examples of them are: an image recording apparatus such as a printer, a liquid ejecting apparatus used in the production of a color filter for a liquid crystal display device, etc. A certain type of a liquid ejecting head ejects liquid in the form of droplets when voltage is applied to piezoelectric elements provided on a surface of a diaphragm plate. The voltage is applied thereto so as to cause the piezoelectric elements to get deformed in accordance with driving signals supplied from a driving circuit. Such a liquid ejecting head is provided with a head unit that includes the diaphragm plate, pressure generation chambers, nozzle orifices, and a manifold. The diaphragm plate constitutes a ceiling part of each of the pressure generation chambers. The diaphragm plate, a flow passage formation substrate, a nozzle plate, which is a plate through which the nozzle orifices are formed, are laid one on another for manufacturing the head unit. For example, an ink-jet recording head manufactured by co-firing plate members made of ceramics is known as an example of such a liquid ejecting head as disclosed in JP-A-10-286956.

If insulating ceramics is used as the material of each of a diaphragm plate, a flow passage formation substrate, and a nozzle plate, and if these insulating ceramic plate members are co-fired, the insulating ceramics will be charged due to piezoelectric-element electrification or due to static electricity. Therefore, there is a risk that the dielectric breakdown of the diaphragm plate might occur, or a driving circuit may get damaged through the electrodes of the piezoelectric elements.

SUMMARY

To solve the above problems without any limitation thereto, the invention provides, as various aspects thereof, a liquid ejecting head and a liquid ejecting apparatus having features stated in Application Examples below or described as an exemplary mode.

APPLICATION EXAMPLE 1

A liquid ejecting head according to an aspect of the invention includes: a flow passage formation substrate in which pressure generation chambers and liquid flow passages demarcated by partition walls are formed, the flow passage formation substrate being made of ceramics; a diaphragm plate that is provided on one surface of the flow passage formation substrate to constitute a part of each of the pressure generation chambers and each of the liquid flow passages, the diaphragm plate being made of insulating ceramics; piezoelectric elements that are provided on one surface of the diaphragm plate each at a position where the piezoelectric element overlaps the corresponding pressure generation chamber with the diaphragm plate interposed therebetween, the piezoelectric element including a pair of electrodes; a driving circuit that is connected to the electrodes; and a nozzle plate in which nozzle orifices that are in communication with the pressure generation chambers are formed, the nozzle plate being made of conductive ceramics.

The above application example offers the following advantage. The nozzle plate is made of conductive ceramics. The nozzle plate is grounded. Therefore, electric charges do not easily accumulate on the nozzle plate. The migration of electric charges from the nozzle orifices to the diaphragm plate through liquid filled in the pressure generation chambers is unlikely to occur or significantly less likely to occur. Thus, it is possible to prevent the dielectric breakdown of the diaphragm plate caused conventionally by accumulated electric charges and to provide a liquid ejecting head that is substantially free from the damage of a driving circuit due to the inflow of electric charge.

APPLICATION EXAMPLE 2

The liquid ejecting head further includes a conductive cover case for encasing the nozzle plate, wherein the nozzle plate is grounded via the cover case.

The nozzle plate is grounded via the conductive cover case. Therefore, with the above application example, besides the advantageous effect described above, the liquid ejecting head offers a structure for protecting the nozzle plate.

APPLICATION EXAMPLE 3

In the liquid ejecting head, the flow passage formation substrate, the diaphragm plate, and the nozzle plate are co-fired.

The flow passage formation substrate, the diaphragm plate, and the nozzle plate, each of which is made of ceramics, are co-fired. Therefore, with the above application example, it is possible to reduce the displacement of the flow passage formation substrate, the diaphragm plate, and the nozzle plate relative to one another due to thermal contraction and to provide a liquid ejecting head that can be assembled easily.

APPLICATION EXAMPLE 4

A liquid ejecting apparatus is provided with the liquid ejecting head described above.

With the above application example, it is possible to provide a liquid ejecting apparatus that can produce the advantageous effects described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
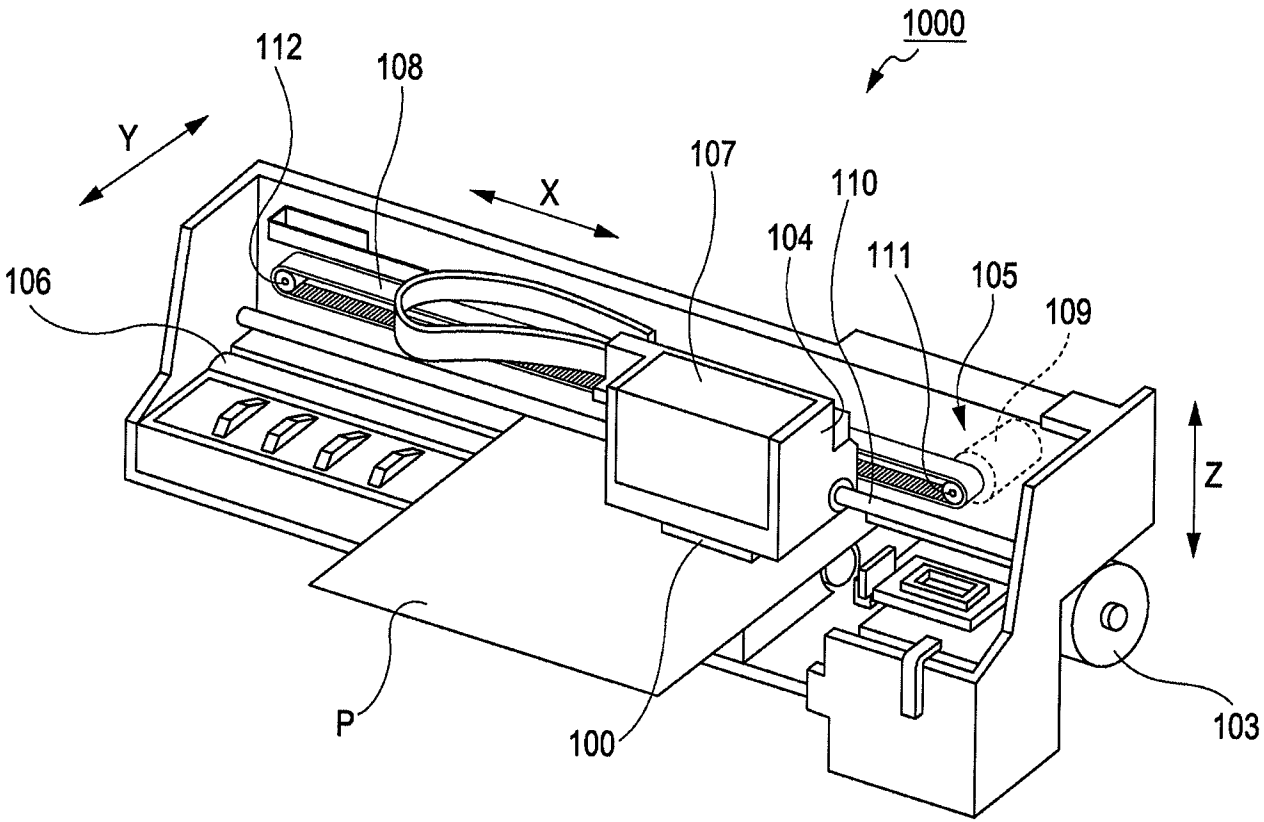
FIG. 1 is a perspective view that schematically illustrates an example of the structure of a printer according to an exemplary embodiment of the invention.

With reference to the accompanying drawings, an exemplary embodiment of the present invention will now be explained in detail. In order to make it easier to understand the concept of the embodiment, the configuration is partially omitted or shown in an exaggerated manner in the drawings.

In the following description, a configuration in which an ink-jet recording head 100 is mounted on a printer 1000 functioning as an image recording apparatus is taken as an example. The ink-jet recording head 100 is an example of a liquid ejecting head. The printer 1000 is an example of a liquid ejecting apparatus. FIG. 1 is a diagram that schematically illustrates an example of the structure of the printer 1000. In FIG. 1, X denotes a main scan direction, which is a direction in which a carriage 104 travels. Y denotes sub scan direction, which is a direction in which a recording target medium P is transported. Z denotes a direction that is orthogonal to the X and Y directions.

As illustrated in FIG. 1, the printer 1000 is provided with the ink-jet recording head 100, the carriage 104, a carriage movement mechanism 105, a platen roller 106, and ink cartridges 107.

The ink-jet recording head 100 is mounted on a recording-target-medium-side surface (that is, the surface closer to the recording target medium P; the lower surface in the Z direction in FIG. 1) of the carriage 104. The ink-jet recording head 100 ejects ink in the form of droplets onto the surface of the recording target medium P. The carriage movement mechanism 105 includes a timing belt 108, a driving pulley 111, a driven pulley 112, and a motor 109. The carriage 104 is attached to the timing belt 108. The timing belt 108 is stretched between the driving pulley 111 and the driven pulley 112. The driving pulley 111 is connected to the output shaft of the motor 109. Therefore, as the motor 109 operates, the carriage 104 reciprocates in the X direction, that is, the main scan direction, while being guided along a guide rod 110 supported inside the casing of the printer 1000.

Driven by a motor 103, the platen roller 106 rotates to transport the recording target medium P in the Y direction, that is, the sub scan direction. The ink cartridges 107, which contain ink, are detachably attached to the carriage 104. Ink is supplied from the ink cartridges 107 to the ink-jet recording head 100.

The printer 1000 having the structure described above can print an image, etc. on the recording target medium P such as recording paper by ejecting ink in the form of droplets from the ink-jet recording head 100 mounted on the carriage 104 while moving the carriage 104 in the X direction in a reciprocating manner by means of the carriage movement mechanism 105 and transporting the recording target medium P in the Y direction by means of the platen roller 106.

Figure 2:
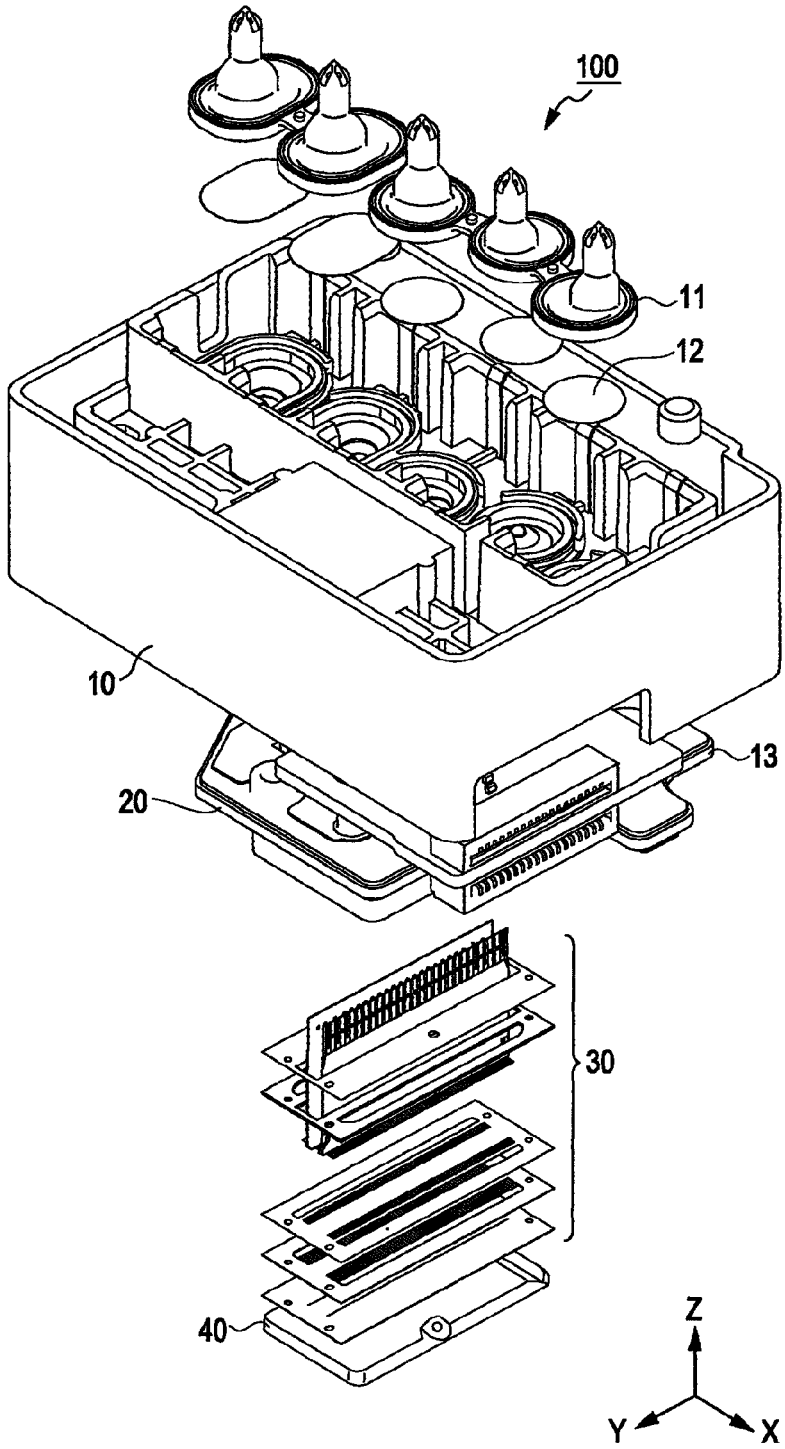
FIG. 2 is an exploded perspective view that schematically illustrates an example of the structure of an ink-jet recording head.

FIG. 2 is an exploded perspective view that schematically illustrates an example of the structure of the ink-jet recording head 100. The main scan direction X, the sub scan direction Y, and the direction Z orthogonal to these directions X and Y are shown in FIG. 2 as in FIG. 1. As illustrated in FIG. 2, the ink-jet recording head 100 includes a mounting plate 10, a case head 20, a head unit 30, and a cover case 40. The head unit 30 is provided on the bottom of the case head 20. The head unit 30 is encased in the cover case 40. Though/ a single head unit 30 and a single cover case 40 are shown in FIG. 2, a plurality of combined components may be adopted as a substitute for the illustrated single component.

The mounting plate 10 includes needles 11 functioning as inlet members through which ink flows in from the ink cartridges 107 illustrated in FIG. 1. In addition, the mounting plate 10 includes ink filters 12. The case head 20 includes a case-head-side substrate 13 for connection to a flexible printed circuit board 37 described later.

Figure 3:
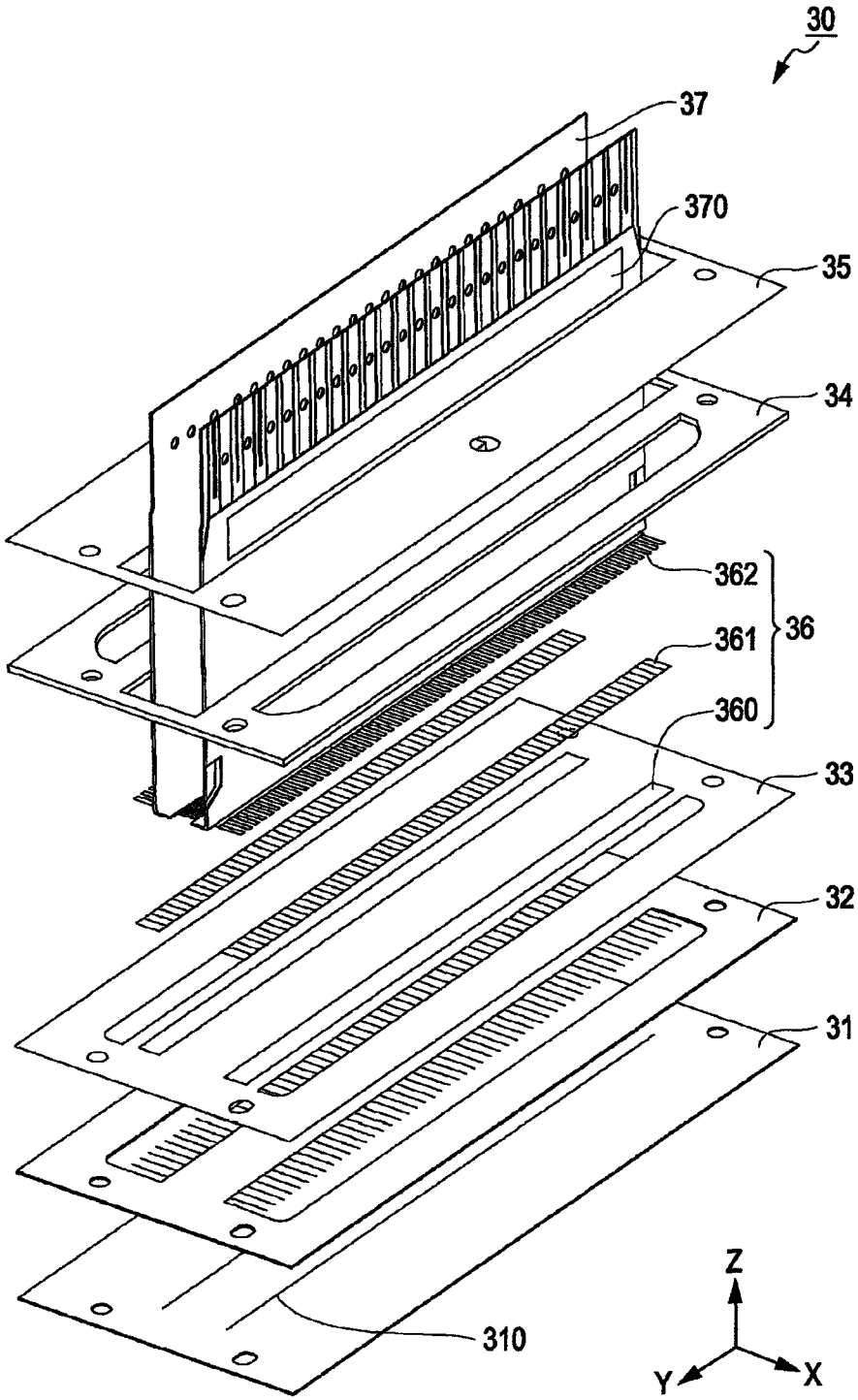
FIG. 3 is an exploded perspective view that schematically illustrates an example of the structure of a head unit.
Figure 4:
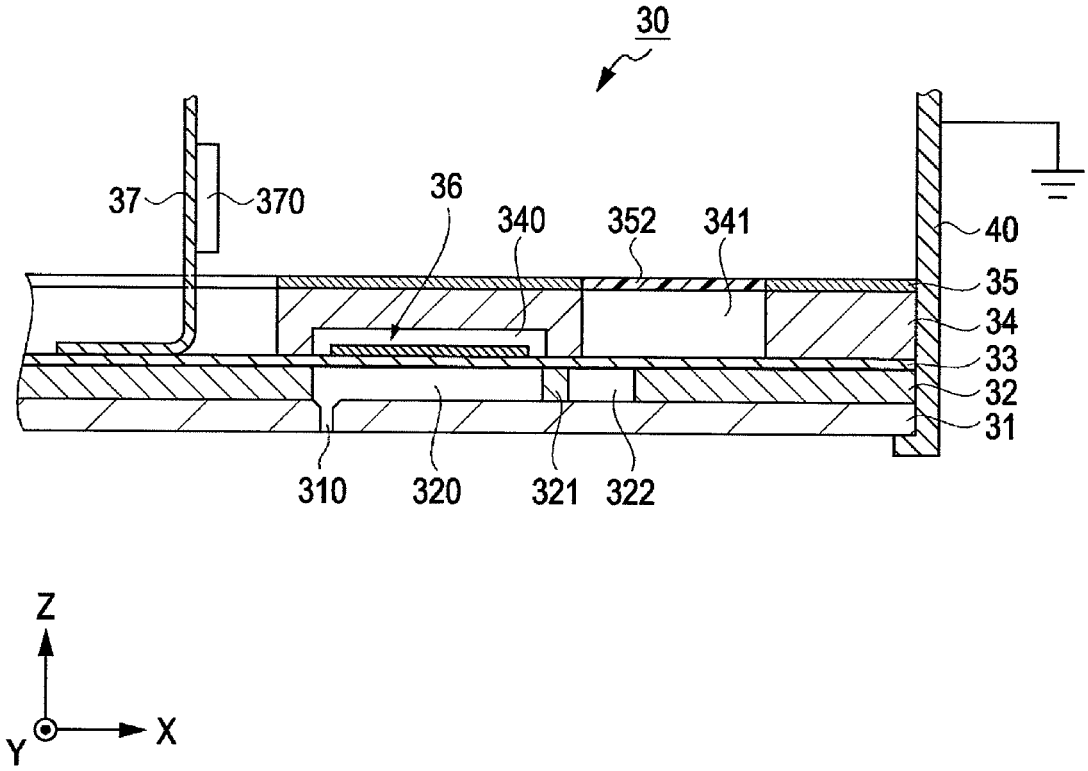
FIG. 4 is a sectional view for explaining an essential part of the head unit and a cover case.

FIG. 3 is an exploded perspective view that schematically illustrates an example of the structure of the head unit 30. FIG. 4 is a sectional view for explaining an essential part of the head unit 30 and the cover case 40. The main scan direction X, the sub scan direction Y, and the direction Z orthogonal to these directions X and Y are shown in FIGS. 3 and 4, too. As illustrated in FIGS. 3 and 4, the head unit 30 includes a nozzle plate 31, which is provided at a position where the nozzle plate 31 faces the recording target medium P illustrated in FIG. 1. Nozzle orifices 310 through which ink is ejected are formed in the nozzle plate 31. The nozzle orifices 310 are formed at a pitch corresponding to dot-forming density. A flow passage formation substrate 32, a diaphragm plate 33, a reservoir plate 34, and a compliance plate 35 are provided in layers over the nozzle plate 31. The flow passage formation substrate 32 is a plate member having passages through which ink is supplied to the nozzle plate 31.

As illustrated in FIG. 4, passage holes functioning as pressure generation chambers 320, ink supply passages 321 that are in communication with the pressure generation chambers 320, and a communication portion 322 are formed in the flow passage formation substrate 32. The pressure generation chamber 320 has a rectangular cross-sectional shape as viewed in the width direction of the ink-jet recording head 100, that is, the X direction, which is orthogonal to the length direction of the ink-jet recording head 100, that is, the Y direction. The pressure generation chamber 320 is elongated in the width direction X of the ink-jet recording head 100. This direction is defined as the length direction of the pressure generation chamber 320. The cross-sectional shape is not limited to a rectangle. For example, it may be a trapezoid.

The communication portion 322 is formed at an area outside the pressure generation chambers 320 in the flow passage formation substrate 32 as viewed in the length direction of the pressure generation chamber 320. The communication portion 322 is in communication with each of the pressure generation chambers 320 through the corresponding ink supply passage 321 formed for the pressure generation chamber 320. The ink supply passage 321 is an example of a liquid supply passage. The width of the ink supply passage 321 is smaller than that of the pressure generation chamber 320. Having such a narrower structure, the ink supply passage 321 keeps the flow passage resistance of ink that flows from the communication portion 322 into the pressure generation chamber 320 therethrough at a constant level.

The diaphragm plate 33, which is provided on the flow passage formation substrate 32, constitutes a ceiling part of the pressure generation chamber 320. Piezoelectric elements 36 are provided on the diaphragm plate 33. The piezoelectric element 36 vibrates due to flexural oscillation when a voltage is applied thereto. As illustrated in FIG. 3, the piezoelectric element 36 includes a lower electrode 360, a piezoelectric substance 361, and an upper electrode 362. The lower electrode 360 is a grounded common electrode. The upper electrode 362 is an individual electrode. The plurality of piezoelectric elements 36, each of which is provided for the corresponding one of the plurality of pressure generation chambers 320, are arranged in a line in the direction in which a line of nozzles is formed. The piezoelectric elements 36 are provided on one surface of the diaphragm plate 33 opposite to the other surface that is closer to the pressure generation chambers 320. The piezoelectric elements 36 are arranged in such a way as to cover the pressure generation chambers 320 respectively with the diaphragm plate 33 interposed therebetween.

For example, metal such as platinum or iridium or, alternatively, metal oxide such as lanthanum nickelate (LNO) or strontium ruthenate (SrRuO) can be used as a material for forming the lower electrode 360. For example, metal such as platinum or iridium can be used as a material for forming the upper electrode 362. A sputtering method, a vapor deposition method, or the like can be used for forming these electrodes.

Lead zirconate titanate can be used as the material of the piezoelectric substance 361. A so-called sol-gel method can be used as a method for manufacturing the film of the piezoelectric substance 361. Specifically, in the sol-gel method, so-called sol obtained by either dissolving or dispersing a metal organic matter into a catalyst is applied and dried to form it into gel. Then, it is fired at a high temperature to obtain the film of the piezoelectric substance 361 that is made of metal oxide. Note that the method for manufacturing the film of the piezoelectric substance 361 is not limited to the sol-gel method. For example, an MOD (Metal-Organic Decomposition) method may be used. Moreover, the method for manufacturing the film of the piezoelectric substance 361 is not limited to these liquid-phase methods. For example, a sputter deposition method may be used.

Each of the nozzle plate 31, the flow passage formation substrate 32, and the diaphragm plate 33 is made of a ceramic plate using alumina, zirconia, or the like. These plate members are co-fired for connection to each other. In the present embodiment of the invention, conductive ceramics is used as the material of the nozzle plate 31, whereas insulating ceramics is used as the material of each of the flow passage formation substrate 32 and the diaphragm plate 33. The nozzle plate 31 is encased in the cover case 40. The nozzle plate 31 is grounded via the ink-jet recording head 100 and the printer 1000. A ceramic substance obtained by dispersing conductive particles in insulating ceramics such as alumina or zirconia can be used as the conductive ceramics. An example of the conductive particles is silicon particles.

The following method can be used for co-firing. For example, necessary passage holes, etc. are formed in a green sheet (sheet material that has not been fired yet) by drilling, punching, or the like to form a sheet-type precursor for each of the nozzle plate 31, the flow passage formation substrate 32, and the diaphragm plate 33. Next, the sheet-type precursors are laid one on another and then fired. As a result, the sheet-type precursors form into a single ceramic sheet. Since the sheet-type precursors are co-fired to form into a single sheet, no special bonding processing is necessary. In addition, it is possible to obtain high sealing property on the adhesion surface of each of the sheet-type precursors.

As illustrated in FIG. 4, a piezoelectric element housing portion 340 for protecting the piezoelectric elements 36 and a passage hole functioning as a reservoir portion 341 are formed in the reservoir plate 34. The reservoir portion 341 is in communication with the communication portion 322. The reservoir plate 34 is bonded to the diaphragm plate 33. The communication portion 322 and the reservoir portion 341 are collectively called as manifold. The compliance plate 35 is bonded to one surface of the reservoir plate 34 opposite to the other surface that is bonded to the diaphragm plate 33. A region of the compliance plate 35 that corresponds to the reservoir portion 341 is made of a flexible film 352. The flexible film 352 absorbs pressure fluctuation occurring in the manifold.

As illustrated in FIG. 3, the flexible printed circuit board 37 is inserted through the reservoir plate 34 and the compliance plate 35. The flexible printed circuit board 37 is connected to the lower electrode 360 and the upper electrodes 362 of the piezoelectric elements 36. A COF (Chip On Film) substrate can be used as the material of the flexible printed circuit board 37. The flexible printed circuit board 37 is connected to the case-head-side substrate 13 provided on the body of the case head 20 illustrated in FIG. 2. Power is supplied from the case-head-side substrate 13 to the flexible printed circuit board 37. A driving circuit 370 is mounted on the flexible printed circuit board 37. The driving circuit 370 performs control processing for supplying driving signals from the case-head-side substrate 13 illustrated in FIG. 2 to the piezoelectric elements 36 on a selective basis.

When a voltage is applied to a piezoelectric vibrator, the piezoelectric element 36 vibrates due to flexural oscillation. As a result of the vibration, ink is ejected from the nozzle orifice 310 of the nozzle plate 31. The ink-jet recording head 100 is configured to eject ink in this way.

The embodiment described above produces the following advantageous effects.

(1) The nozzle plate 31 is made of conductive ceramics. The nozzle plate 31 is grounded. Therefore, electric charges do not easily accumulate on the nozzle plate 31. The migration of electric charges from the nozzle orifices 310 to the diaphragm plate 33 through ink filled in the pressure generation chambers 320 is unlikely to occur or significantly less likely to occur. Thus, it is possible to prevent the dielectric breakdown of the diaphragm plate 33 caused conventionally by accumulated electric charges and to provide the ink-jet recording head 100 that is substantially free from the damage of the driving circuit 370.

(2) The nozzle plate 31 is encased in the grounded conductive cover case 40. Therefore, besides the advantageous effect described above, the ink-jet recording head 100 offers a structure for protecting the nozzle plate 31.

(3) The flow passage formation substrate 32, the diaphragm plate 33, and the nozzle plate 31, each of which is made of ceramics, are co-fired. Therefore, it is possible to reduce the displacement of the flow passage formation substrate 32, the diaphragm plate 33, and the nozzle plate 31 relative to one another due to thermal contraction and to provide the ink-jet recording head 100 that can be assembled easily.

(4) It is possible to provide the printer 1000 that can produce the advantageous effects described above.

The scope of the invention is not limited to the embodiment described above. It can be modified in various ways.

For example, the flow passage formation substrate 32 may be made of conductive ceramics.

In the foregoing description, the ink-jet recording head 100 is taken as an example of a liquid ejecting head. However, a liquid ejecting head according to various aspects of the invention is not limited thereto. The invention can be applied to various types of a liquid ejecting head including but not limited to: a color material ejection head that is used in the production of a color filter for a liquid crystal display device or the like; an electrode material ejection head that is used for the electrode formation of an organic electroluminescence (EL) display device, a surface/plane emission display device (FED), and the like; and a living organic material ejection head that is used for production of biochips.

Though the printer 1000 is taken as an example of a liquid ejecting apparatus according to various aspects of the invention, the liquid ejecting apparatus may be used for industrial applications. Various kinds of functional materials that are dissolved in a solvent or dispersed in a dispersion medium to have moderate viscosity can be used as liquid (a liquid material) to be discharged. Besides an image recording apparatus such as a printer described above, the invention can be applied to various types of a liquid ejecting apparatus including but not limited to: a color material ejection apparatus that is used in the production of a color filter for a liquid crystal display device or the like; a liquid material ejection apparatus that is used for the electrode formation or color-filter production of an organic EL display device, an FED, and the like; and a living organic material ejection apparatus that is used for production of biochips.

The entire disclosure of Japanese Patent Application No. 2011-071872, filed Mar. 29, 2011 is incorporated by reference herein.

What is claimed is:

1. A liquid ejecting head comprising:

a flow passage formation substrate in which pressure generation chambers and liquid flow passages demarcated by partition walls are formed, the flow passage formation substrate being made of ceramics;

a diaphragm plate that is provided on one surface of the flow passage formation substrate to constitute a part of each of the pressure generation chambers and each of the liquid flow passages, the diaphragm plate being made of insulating ceramics;

piezoelectric elements that are provided on one surface of the diaphragm plate each at a position where the piezoelectric element overlaps the corresponding pressure generation chamber with the diaphragm plate interposed therebetween, the piezoelectric element including a pair of electrodes;

a driving circuit that is connected to the electrodes; and a nozzle plate in which nozzle orifices that are in communication with the pressure generation chambers are formed, the nozzle plate being made of conductive ceramics.

2. The liquid ejecting head according to claim 1, further comprising a conductive cover case for encasing the nozzle plate, wherein the nozzle plate is grounded via the cover case.

3. The liquid ejecting head according to claim 1, wherein the flow passage formation substrate, the diaphragm plate, and the nozzle plate are co-fired.

4. A liquid ejecting apparatus that is provided with the liquid ejecting head according to claim 1.

5. A liquid ejecting apparatus that is provided with the liquid ejecting head according to claim 2.

6. A liquid ejecting apparatus that is provided with the liquid ejecting head according to claim 3.

* * * * *